US011772414B1

(12) United States Patent
Perrier

(10) Patent No.: US 11,772,414 B1
(45) Date of Patent: Oct. 3, 2023

(54) DIAMOND ART CANVAS

(71) Applicant: Diamond Art Club, LLC, Miami, FL (US)

(72) Inventor: Alexandre Perrier, Los Angeles, CA (US)

(73) Assignee: Diamond Art Club, LLC, Miami, FL (US)

( * ) Notice: Subject to any disclaimer, the term of this patent is extended or adjusted under 35 U.S.C. 154(b) by 0 days.

(21) Appl. No.: 18/305,289

(22) Filed: Apr. 21, 2023

(51) Int. Cl.
*B44D 3/18* (2006.01)

(52) U.S. Cl.
CPC ..... *B44D 3/18* (2013.01)

(58) Field of Classification Search
CPC ..... B44D 3/18
See application file for complete search history.

(56) References Cited

U.S. PATENT DOCUMENTS

2017/0316713 A1* 11/2017 Hyman ..... B44D 3/18

* cited by examiner

*Primary Examiner* — Edward J Cain
(74) *Attorney, Agent, or Firm* — KOS IP Law LLP

(57) ABSTRACT

A diamond art kit includes a diamond art canvas which includes a layer of adhesive. A protective film having perforated tear lines releasably covers the adhesive. The protective film is divided into several sections defined by the tear lines. A user can tear the protective film along the tear lines so as to remove only a chosen section of the protective film. This will expose a working portion of the canvas adhesive corresponding to that chosen section, but the protective film will remain in place protecting the remaining adhesive. The user can then place drills in the working portion of the canvas.

11 Claims, 2 Drawing Sheets

DIAMOND ART CANVAS

CROSS-REFERENCE TO RELATED APPLICATIONS

Not applicable.

BACKGROUND

The present disclosure relates to hobby art, and more particularly to diamond painting.

Diamond painting is a form of mosaic art in which small beads, referred to as jewels, diamonds or drills, are attached to a sticky canvas. Typically the canvas is pre-printed with an image divided into a grid of spaces. Each space includes a symbol corresponding to a particular color of drill, and the user places appropriate drills into spaces in order to create the image, similar to the paint-by-numbers concept.

A diamond art canvas includes an adhesive layer for holding the drills that are placed thereon. A plastic protective film is disposed over the adhesive. During diamond painting, the user will peel back the protective film in order to access and place drills onto the canvas. After some time, the user may wish to take a break from diamond painting, and will re-place the protective film in order to protect the remaining exposed adhesive. When the protective film is pulled back, the adhesive is exposed to environmental factors that tend to foul the adhesive and reduce its ability to hold drills in place. Thus, it is common for diamond painters to use a separate release paper to apply to portions of the canvas to protect the adhesive when the protective film has been pulled back.

SUMMARY

The present disclosure discloses aspects that improve diamond art canvases by enabling better protection of canvas adhesive layers without the need for separate release papers. For example, a diamond art canvas can have a protective film having perforated tear lines. The protective film is divided into several sections defined by the tear lines. A user can tear the protective film along the tear lines so as to remove only a chosen section of the protective film. This will expose a working portion of the canvas adhesive corresponding to that chosen section, but the protective film will remain in place protecting the remaining adhesive. The user can then place drills in the working portion of the canvas.

In accordance with one embodiment, the present specification provides a diamond art canvas, comprising a substrate defining an image surface upon which an image is printed, an adhesive applied to the image surface, and a protective film disposed atop the adhesive. The protective film is configured to be releasably removed from and reengaged with the adhesive. The protective film further comprises a plurality of tear lines at which the protective film is configured to preferentially tear. The plurality of tear lines define a plurality of sections of the protective film. The tear lines are configured so that one or more of the plurality of sections of the protective film can be separated from the remaining ones of the plurality of sections.

In some variations the tear lines are perforated.

In additional variations, a first one of the plurality of sections has a greater area than a second one of the plurality of sections. A first one of the tear lines can be substantially straight and a second one of the tear lines can be arcuate.

In further variations the image has an image feature, and one or more of the tear lines are configured to define a feature section of the protective film, the feature section generally corresponding to the size and shape of the image feature.

In some variations the diamond art canvas is combined with a container comprising a plurality of drills, wherein the plurality of drills in the container correspond to the image feature. In some such variations the feature section of the protective film has a section code marked thereon and the container has the section code marked thereon.

In a yet further variation the protective film comprises a first edge and a second edge, and the diamond art canvas additionally comprises a second protective film having a first edge and a second edge. The first edge of the second protective film is adjacent the second edge of the protective film. In some such variations a tab extends from the first edge of the second protective film and overlaps the second edge of the protective film.

In accordance with another embodiment the present specification provides a method of diamond painting. The method comprises peeling back a portion of a protective film disposed over an adhesive layer of a canvas, tearing the protective film along one or more tear lines that are preformed on the protective film so as to remove a section of the protective film so that a working portion of the canvas corresponding to the removed section of the protective film is exposed, ensuring the remaining portion of the protective film is engaged with the adhesive layer, and placing a plurality of drills onto the canvas in the working portion.

In some such embodiments the protective film comprises a plurality of tear lines, and the method additionally comprises selectively tearing one or more of the plurality of tear lines while keeping the rest of the tear lines intact.

DESCRIPTION

Figure 1:
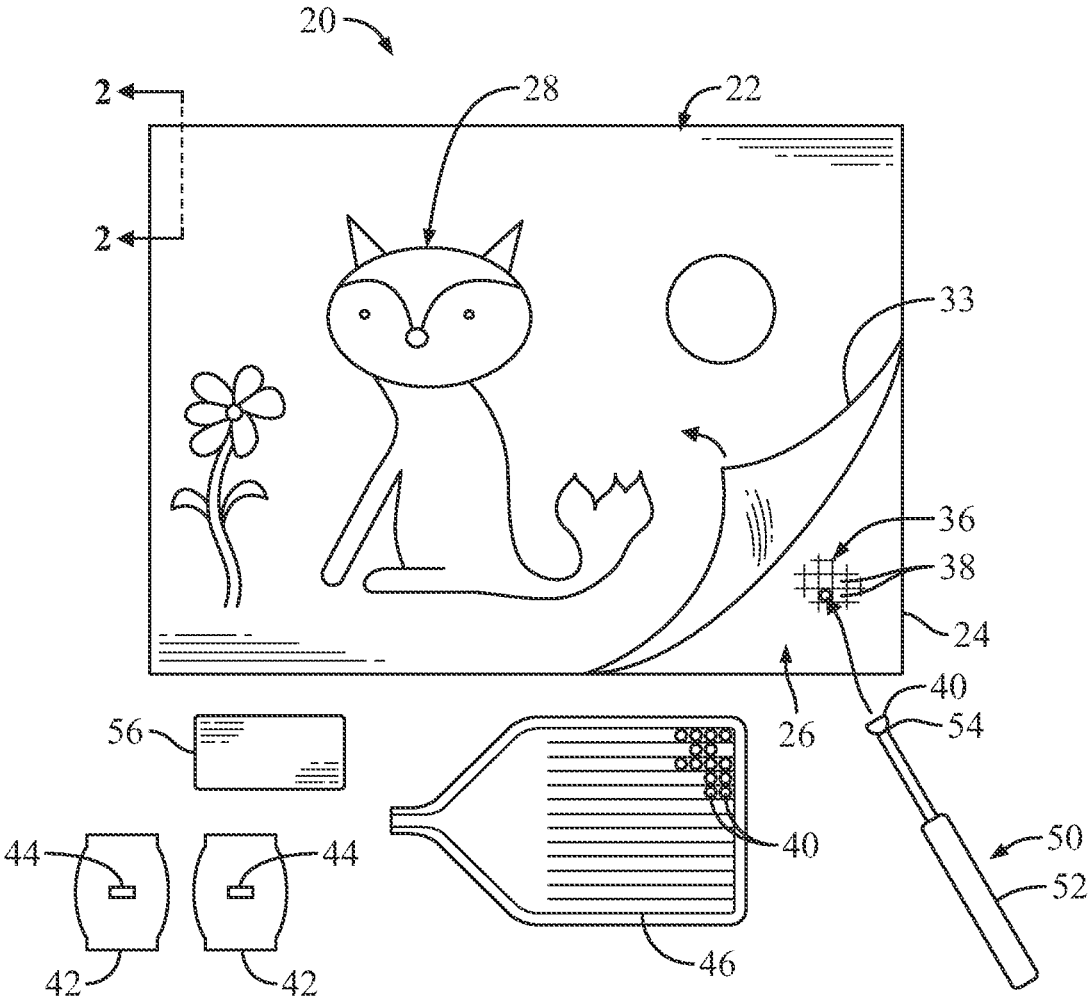
FIG. 1 is a schematic view of an embodiment of a diamond art kit.

The present disclosure discloses aspects that improve diamond art kits by protecting the adhesive layer on the canvas without the need to constantly remove and apply a release paper so as to soil the adhesive as the user works on the diamond art over multiple sessions. A diamond art canvas 22, which includes a layer of adhesive 30 (see FIG. 2), can have a protective film 33 having perforated tear lines 60 (see FIGS. 3 and 4). The protective film 33 is divided into several sections defined by the tear lines 60. A user can tear the protective film 33 along the tear lines 60 so as to remove only a chosen section of the protective film. This will expose a working portion of the canvas adhesive 30 corresponding to that chosen section, but the protective film 33 will remain in place protecting the remaining adhesive 30. The user can then place drills 40 in the working portion of the canvas 22.

Figure 2:
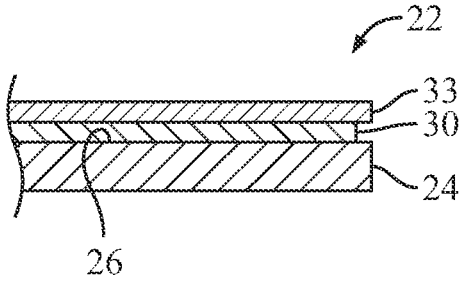
FIG. 2 is a cross-sectional view taken along line 2-2 of FIG. 1.

With initial reference to FIGS. 1 and 2, a diamond art kit 20 includes a canvas 22 comprising a substrate 24 having an image surface 26 (see FIG. 5) upon which an image 28 is printed. A layer of adhesive 30 is applied over the image surface 26. A protective film 33 is applied atop the adhesive 30. As shown, the protective film 33 can be peeled back to expose the adhesive 30.

The image 28 is divided into a grid 36 defining spaces 38, each of which includes a symbol. A plurality of drills 40 are provided. Drills are an industry term for clear or colored faceted resin bodies that absorb and reflect light similar to diamonds. It is anticipated that one drill 40 will be placed in each space 38. The symbol in each space corresponds to a particular color of drill 40, and the user is to place the corresponding drill 40 in each space 38 so as to create a mosaic matching the printed image 28. The drills 40 typically are resin beads having a flat side for placement on the image surface 26, and a plurality of facets adapted to produce a shimmering, reflective effect. Drills 40 are also sometimes called diamonds, gems, or rhinestones, and can be made of a variety of materials and also have a variety of specific shapes.

With continued reference to FIG. 1, the drills 40 often are provided in bags 42 which preferably have a label 44 corresponding to, for example, the symbol associated with the particular drill color contained in the bag 42. In use, a user will often pour several drills 40 into a tray 46 configured to support them with the facet-side up. An elongated applicator 50 can include a handle 52 and a tip 54.

To place a drill 40, a user first peels the protective film 33 back, exposing the adhesive 30. The user then dips the tip 54 of the applicator 50 into a wax pad 56. The wax 56 provides a light adhesive affect so that when the user applies the tip 54 onto the facet side of a drill 40 in the tray 46, the drill will stick to the tip 54 (as shown in FIG. 1). The user can then apply the drill 40 to the corresponding space 38. Once applied to the space 38, the strong adhesive 30 will hold the drill 40 in place on the canvas 22, and the applicator 50 can be removed. As shown, however, peeling back the protective film 33 can expose far more of the adhesive 30 than is necessary for placing the drill 40 in the space 38.

Figure 3:
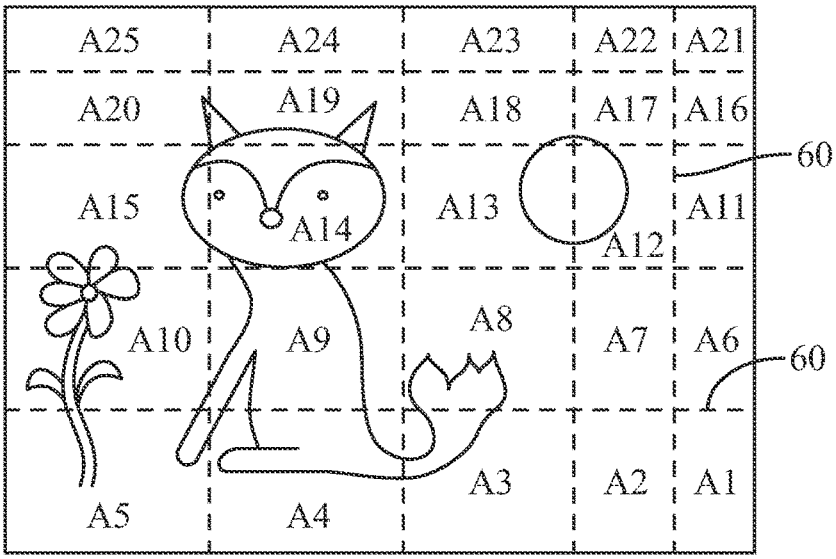
FIG. 3 shows a variation in which a diamond art canvas has a protective film with a plurality of tear lines dividing the protective film into sections.

With reference next to FIG. 3, in one variation, the protective layer 33 comprises a plurality of tear lines 60 at which the protective film 33 is biased to preferentially tear. In the variation shown in FIG. 3, the protective film 33 can be divided by the tear lines 60 into sections A1-A25. A user thus may tear the protective film 33 along one or more of the tear lines 60 in order to expose one or more of the sections A1-A25 while keeping the protective film 33 in place on the remaining sections. This limits exposure of the adhesive to only the section upon which the user is currently working.

In the variation shown in FIG. 3, each tear line 60 is straight and parallel to one of the edges of the canvas 22. As such, each section A1-A25 forms a rectangular shape. The illustrated variation also has sections of various sizes so that a user can choose to open a larger or smaller section depending on how much time they wish to spend working on their diamond painting. It is to be understood that variations can be configured so that all sections are the same size, and variations can also be configured with sections of various sizes and shapes, in which tear lines 60 may or may not be parallel to one another and may or may not extend across the entire canvas 22.

Figure 4:
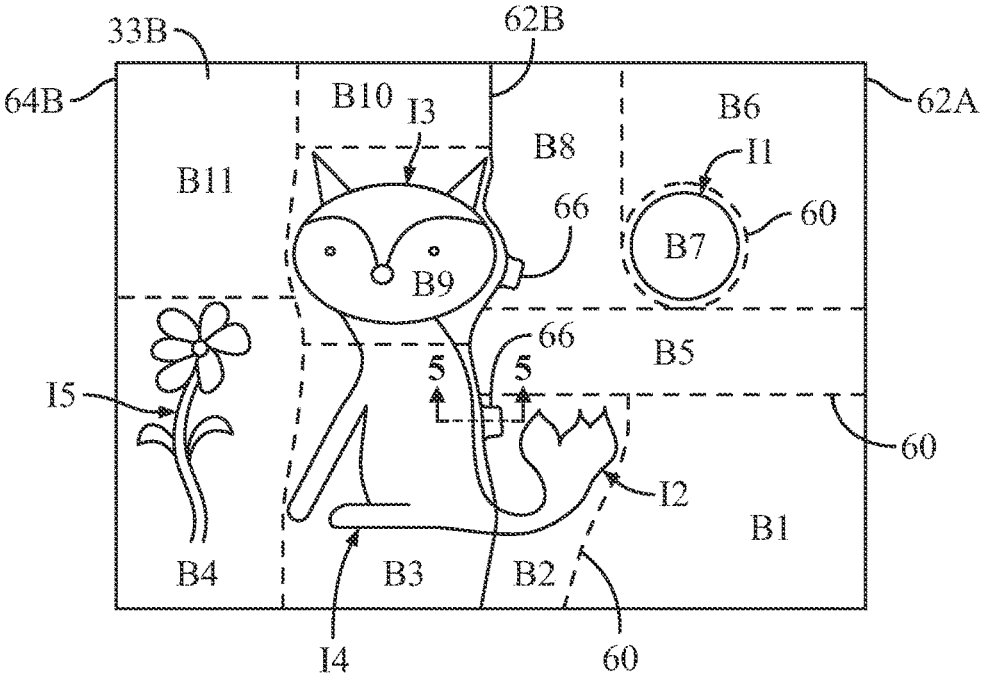
FIG. 4 shows another variation in which a diamond art canvas has a protective film with a plurality of tear lines dividing the protective film into sections.

In the variation depicted in FIG. 3, the tear lines 60 are placed without consideration of the underlying image 28 printed on the canvas 22. With reference next to FIG. 4, an additional variation is depicted in which tear lines 60 of the protective film 33 are arranged to define sections B1-B11 that generally conform to at least some image features I1-I5 of the image 28. For example, image feature I1 in the illustrated image 28 appears to be a round sun. A correspondingly round tear line 60 circumscribes this image feature I1, defining section B7, which corresponds to this image feature I1. As such, a user wishing to work on this particular image feature I1 can tear out and remove section B7 of the protective film 33 to expose the image feature I1 so drills 40 can be appropriately placed on this portion of the canvas 22 while adhesive 30 in surrounding sections remains protected. Similarly, image features including the tail 12, head 13 or body 14 of a fox are respectively defined by sections B2, B9 and B3. Such sections can be defined as broadly or narrowly as desired. For example, section B7 is made up almost entirely of the sun of image feature I1, but section B2 includes not only the tail of image feature 12, but also surrounding environmental features. It is to be understood that sections can be defined even more narrowly—such as a separate section for each of the petals of the flower in image feature I5.

Figure 5:
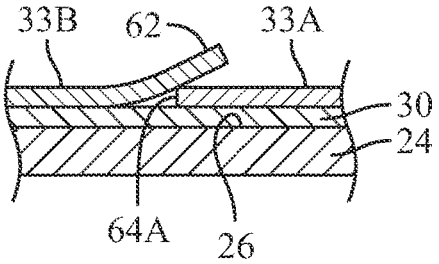
FIG. 5 is a cross-sectional view taken along lines 5-5 of FIG. 4.

FIGS. 4 and 5 also depict another variation in which the protective film 33 comprises multiple separately-formed films, here a first protective film 33A and a second protective film 33B. The first protective film 33A extends from a first end 62A that is aligned with an edge of the canvas 22 to a second end 64A positioned midway across the canvas 22. The second protective film 33B extends from a first end 62B that is generally aligned with and adjacent the second end 64A of the first protective film 33A to a second end 64B that is aligned with an opposing edge of the canvas 22. Tabs 66 can be provided along the first edge 62B, which tabs 66 overlap the second edge 64A so as to help a user obtain purchase on the second protective film 33B.

In some variations the sections B1-B11 can be configured to correspond to one or a limited number of colors of drills 40, so that when a user removes the protective film 33 within a particular section only a limited number of different types of drills 40 will be used for the exposed portion. In some variations the drills 40 can be packaged in bags 42 corresponding to particular sections. In such instances a label 44 of a bag 42 can correspond to a particular section B1-B11, which section number can be printed, for example, on the appropriate location of the protective film 33. A limited number of different types of drills 40 can correspond to that section, and each different type of drill 40 can be placed in its own bag (and with its own label) within the larger bag 42 that corresponds to the selected section. Thus, each section's drills 40 can be separately bagged for the convenience of the user in 1) exposing only the particular section being worked on in that diamond painting session; and 2) opening bags only for drills 40 being placed in that particular section. Thus, exposure of adhesive 30 is limited, and exposure of loose drills 40 is also limited to only those drills 40 relevant to the particular section.

As shown in FIG. 4, the tear lines 60, and first ends 62B, can be straight, curved, or combinations of straight and curved portions. Also, it is to be understood that various materials can suitably be used for the substrate 24, adhesive 30 and protective film 33. For example, typically the substrate comprises a flexible fabric having one or more layers, which layers can comprise woven and/or non-woven textiles. Also, the adhesive can be a poured or sprayed adhesive layer, and in some variations can be a double-sided adhesive film or other structure and method used for applying adhesive atop the image surface 26.

The protective film 33 can be formed of a variety of flexible materials, mostly plastics, that are configured to releasably adhere to the adhesive 30. In one variation the protective film 33 comprises a polyethylene terephthalate (PET) film having a thickness about 3.8c (0.38 mm) and having a silica oil coating. Such a film, and other acceptable films, can be obtained from manufacturers such as Dow Corning. In one variation the tear lines 60 comprise lines of perforations through the protective film 33, and it is desired that the perforations are such that the protective film 33 tears readily along the tear lines 60. In one variation the PET film mentioned above is used as the protective film 33, and the tear lines 60 are made up of elongated perforations through the film, each elongated perforation having a cut length of 4 mm, and an uncut space between adjacent perforations is 0.5 mm. Other variations can include a similar, 8:1 ratio of cut/uncut portions defining the tear lines, or may employ greater or lesser ratios as desired and/or as allowed by the film material.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above.

What is claimed is:

1. A diamond art canvas, comprising:

a substrate defining an image surface upon which an image is printed, the substrate having a plurality of markers with unique printed indicia;

an adhesive applied to the image surface;

a plurality of unique diamond drills attachable to the substrate via the adhesive and attachable in a pattern corresponding to the unique printed indicia;

a protective film disposed atop the adhesive, the protective film configured to be releasably removed from and reengaged with the adhesive, the protective film further comprising a plurality of tear lines at which the protective film is configured to preferentially tear, the plurality of tear lines defining a plurality of sections of the protective film;

wherein the tear lines are configured so that one or more of the plurality of sections of the protective film can be separated from the remaining ones of the plurality of sections so that a user can work on a portion of the diamond art canvas.

2. The diamond art canvas of claim 1, wherein the tear lines are perforated.

3. The diamond art canvas of claim 1, wherein a first one of the plurality of sections has a greater area than a second one of the plurality of sections.

4. The diamond art canvas of claim 2, wherein a first one of the tear lines is substantially straight and a second one of the tear lines is arcuate.

5. The diamond art canvas of claim 1, wherein the image has an image feature, and one or more of the tear lines are configured to define a feature section of the protective film, the feature section generally corresponding to the size and shape of the image feature.

6. The diamond art canvas of claim 5, wherein the plurality of drills in the container correspond to the image feature.

7. The diamond art canvas of claim 6, wherein the unique printed indicia is a unique code marked on the substrate and the container has the section code marked thereon.

8. The diamond art canvas of claim 1, wherein the protective film comprises a first edge and a second edge, the diamond art canvas additionally comprising a second protective film having a first edge and a second edge, wherein the first edge of the second protective film is adjacent the second edge of the protective film.

9. The diamond art canvas of claim 8, wherein a tab extends from the first edge of the second protective film and overlaps the second edge of the protective film.

10. A method of diamond painting, comprising:

peeling back a portion of a protective film disposed over an adhesive layer of a canvas;

tearing the protective film along one or more tear lines that are pre-formed on the protective film so as to remove a section of the protective film so that a working portion of the canvas corresponding to the removed section of the protective film is exposed;

allowing the remaining portion of the protective film to be engaged with the adhesive layer; and placing a plurality of drills onto the canvas in the working portion.

11. The method of claim 10, wherein the protective film comprises a plurality of tear lines, and selectively tearing one or more of the plurality of tear lines while keeping the rest of the tear lines intact.

* * * * *